US007185374B2

(12) United States Patent
Rodriguez

(10) Patent No.: US 7,185,374 B2
(45) Date of Patent: Mar. 6, 2007

(54) DISCHARGE VALVE COMPRISING A FLEXIBLE RINGED TUBE FOR TOILETS

(76) Inventor: Edmundo Simental Rodriguez, Av. Jurez No 1305-4, Col. La Paz, 72160 Puebla, Pue. (MX)

( * ) Notice: Subject to any disclaimer, the term of this patent is extended or adjusted under 35 U.S.C. 154(b) by 52 days.

(21) Appl. No.: 10/518,217

(22) PCT Filed: Sep. 11, 2002

(86) PCT No.: PCT/MX02/00088

§ 371 (c)(1),
(2), (4) Date: Dec. 16, 2004

(87) PCT Pub. No.: WO2004/015210

PCT Pub. Date: Feb. 19, 2004

(65) Prior Publication Data

US 2005/0172388 A1 Aug. 11, 2005

(30) Foreign Application Priority Data

Aug. 8, 2002 (MX) ..... PA/u/2002/000246

(51) Int. Cl.
*E03D 1/34* (2006.01)

(52) U.S. Cl. ..... 4/378; 4/391; 4/395; 4/402

(58) Field of Classification Search ..... 4/378, 4/390, 391, 395, 397, 399, 402
See application file for complete search history.

(56) References Cited

U.S. PATENT DOCUMENTS

| | | | | |
|---|---|---|---|---|
| 3,263,240 | A * | 8/1966 | Brewington | 4/399 |
| 3,280,407 | A | 10/1966 | Aaron | |
| 4,017,913 | A | 4/1977 | Judd | |
| 4,338,689 | A * | 7/1982 | Zieg | 4/399 |
| 5,864,893 | A | 2/1999 | Liou | |
| 6,381,764 | B2 * | 5/2002 | Stahlhut | 4/391 |
| 6,397,404 | B1 | 6/2002 | Ferreyra et al. | |
| 6,925,658 | B2 * | 8/2005 | Parker | 4/391 |

* cited by examiner

*Primary Examiner*—Khoa D. Huynh
(74) *Attorney, Agent, or Firm*—Maria Erlinda Co Sarno

(57) ABSTRACT

A discharge valve for toilet tanks comprising a flexible ringed hose held by a couple covering a center hole of the toilet tank and a handle connecting to a wire wrapping around an upper part of the flexible ringed hose. The wire connected to the handle bends and submerge the flexible ringed hose into the liquid inside the toilet tank when the handle pulls the wire upwards thereby allowing liquid to enter the flexible ringed hose to flush the toilet bowl. The liquid stops flowing to the toilet bowl when the flexible ringed hose goes back to its original vertical position when the pull on the wire is released and when the level of the liquid inside the tank is below the top opening of the flexible ringed hose.

14 Claims, 5 Drawing Sheets

DISCHARGE VALVE COMPRISING A FLEXIBLE RINGED TUBE FOR TOILETS

FIELD OF THE INVENTION

The present invention is related to the traditional flushing valves for toilets which empty the tank to the toilet in order to evacuate the waste to the drainage.

BACKGROUND OF THE INVENTION

The flushing valves known use a cone or lid to cover the hole in the center of the tank, they open and close this hole to flush the toilet.

Description of the Technical Problem, Solution to the Same and Advantageous Effects The main technical problem lies in the mechanical functioning of the flushing valves, which are always letting the water leak into the toilet bowl because the cone or lid that cover the center hole of the tank becomes old, twisted, hardened, wrinkled or some particles become wedged between the cone or lid and the edge of the hole. The seat of the cone or lid may also be worn out or dirty.

Solutions

This invention solves the problem by installing a Flushing Valve with a Flexible Ringed hose which is going to provide the necessary water for a discharge to clean the toilet bowl as well as replenish the amount of water that has to remain in the bowl after flushing, thereby avoiding the waste of water that traditional valves allow.

Advantageous Effects

With this flushing valve with flexible ringed hose you totally eliminate the waste of water because of leakage. On the other hand, the existing typical flushing valves receive water into the pipe through a little hose to fill the bowl. This little hose is supplying water continuously while the tank is being filled. This way the waste is approximately one liter on each flush. The little hose supplies more water than it needs to fill the bowl and the rest goes to waste. There are other systems for supplying water into the tank that are more efficient in controlling the amount of water that feeds into the tank than the little hose. These systems are known and are not part of the claimed invention. However, it should be understood that it would be advantageous to combine these systems with the claimed flushing valve to better conserve the water.

Difference Between this Invention and Similar Inventions

Figure 3:
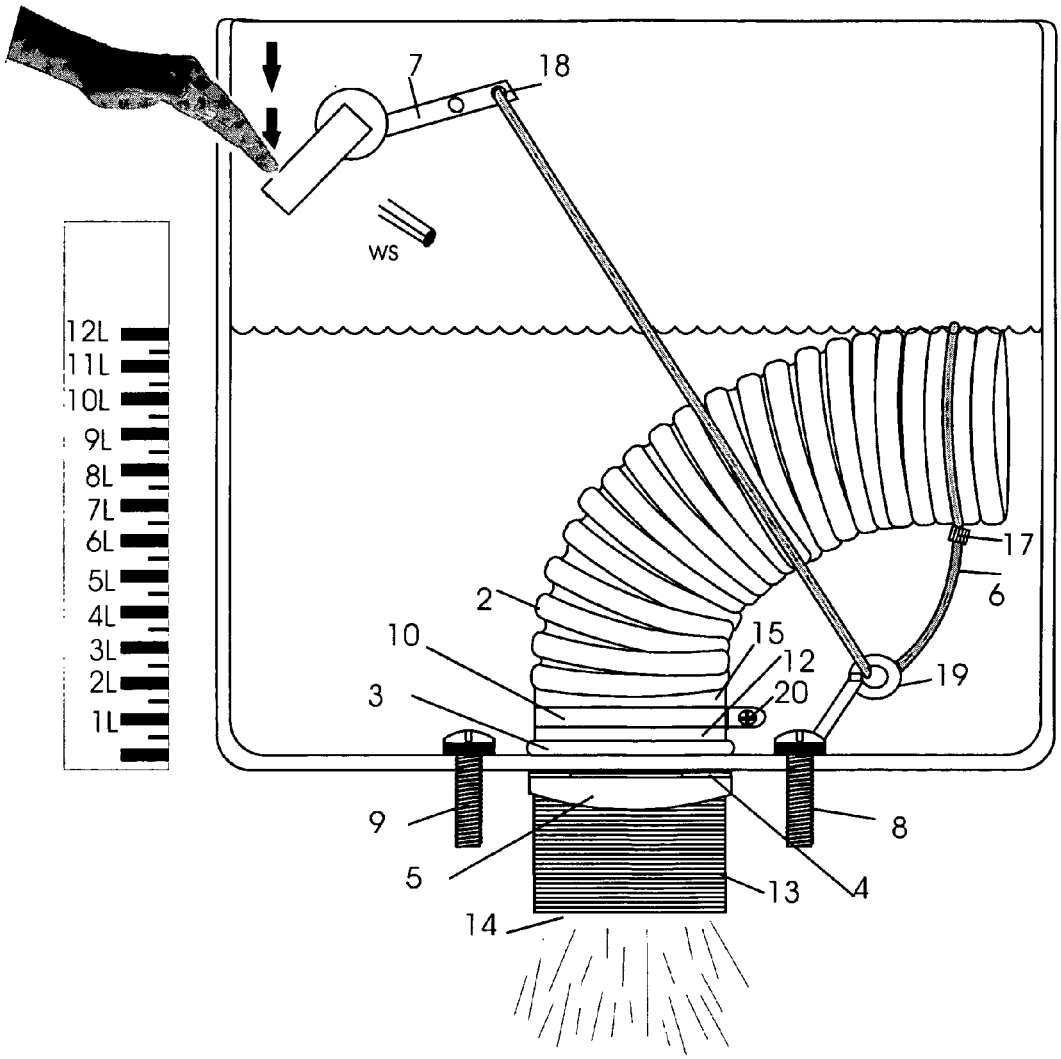

The main difference is: This flushing valve has no lid or cone covering the hole in the center of the tank as the conventional ones. It has a flexible ringed hose which is sealed to the center hole in the tank. Water goes through the center hole of the tank when the flexible ringed hose bends to take the necessary water for one discharge. The flow of water stops when the flexible ringed hose goes back to its original vertical position when the handle that pulls the wire to bend it is released. With the flexible ringed hose bent at an angle of approximately 90 degrees as shown in FIG. 3, approximately only six liters of the 12 liters of water in the tank is needed for one discharge, the rest of the water remains in the tank. The amount of water for one discharge can be adjusted to less than six liters by adjusting for example, the bent of the hose to less than 90 degrees.

Brief Description of the Invention

Figure 1:
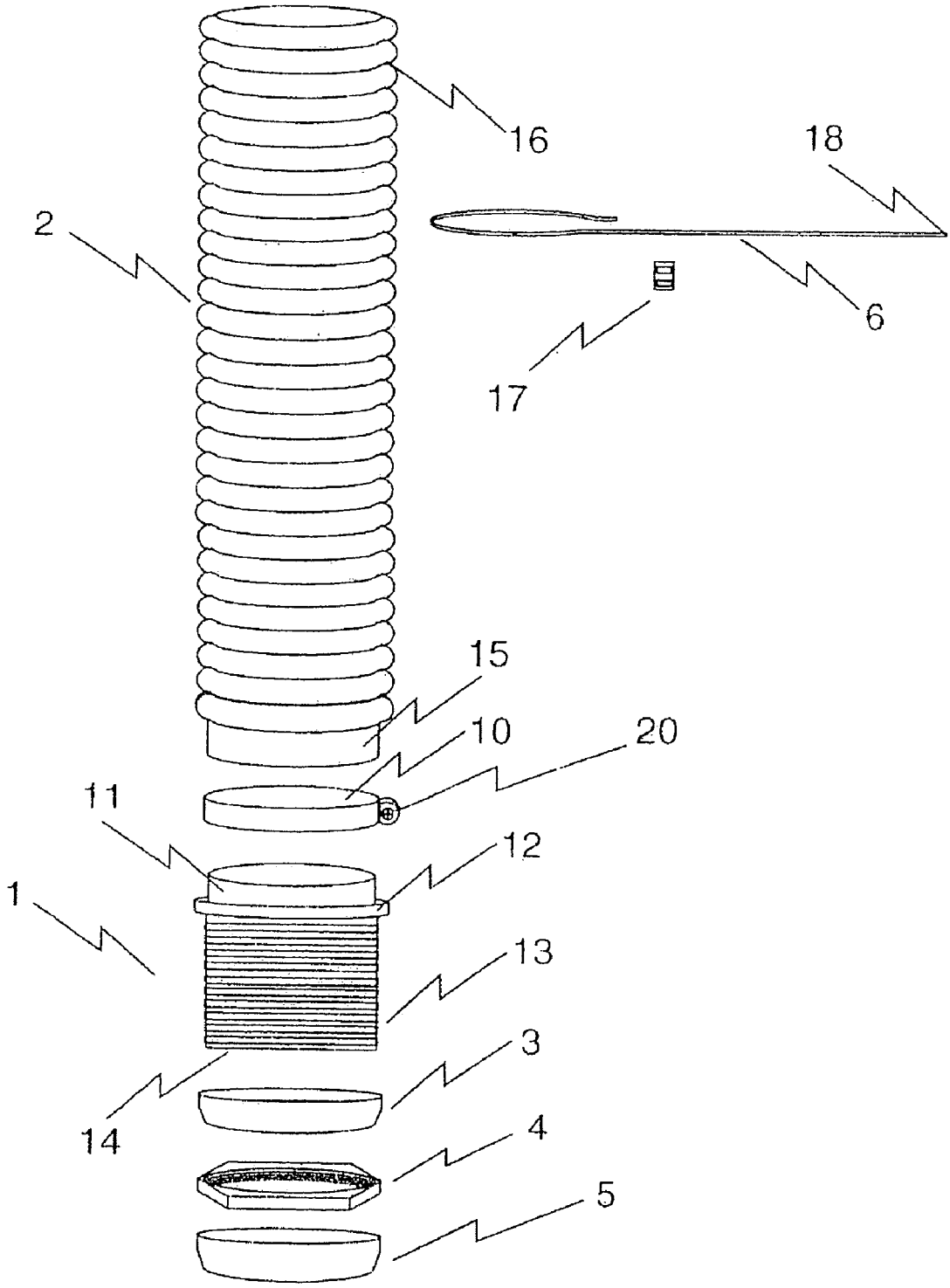
Figure 2:
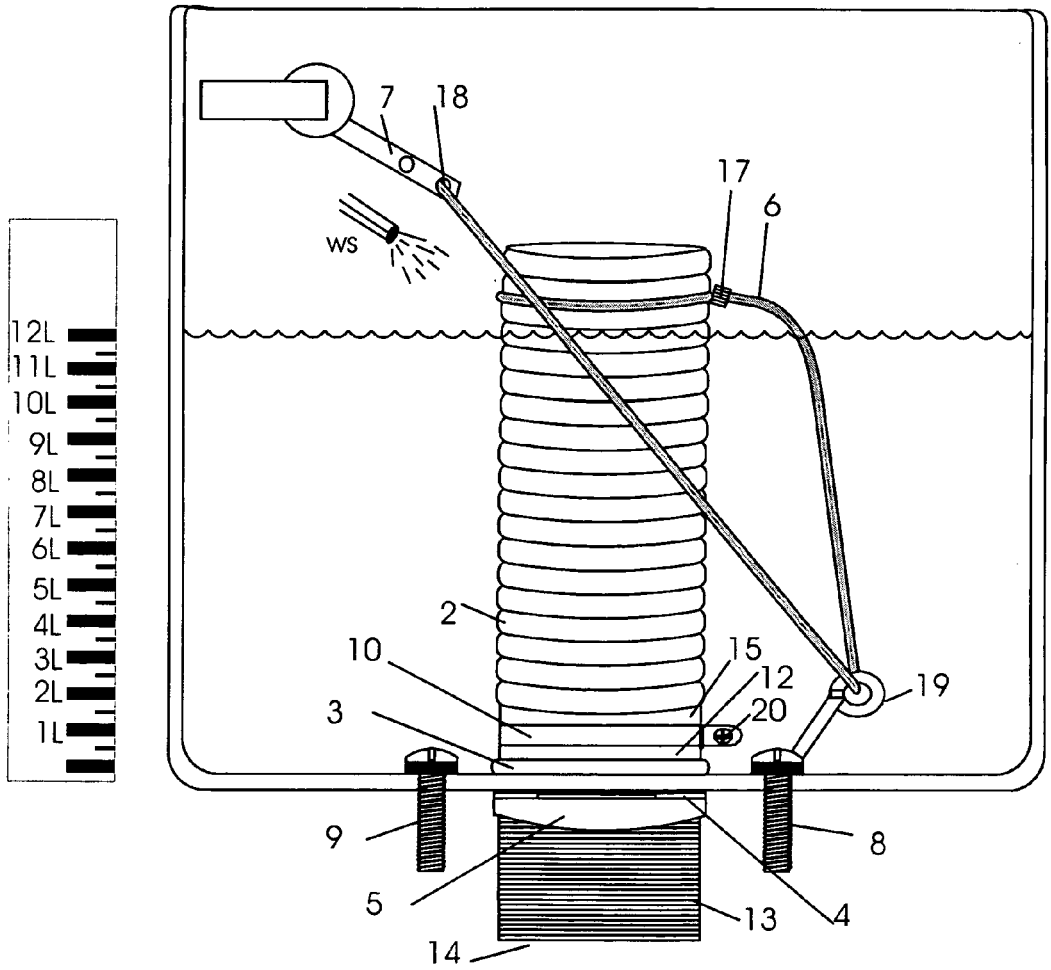
Figure 4:
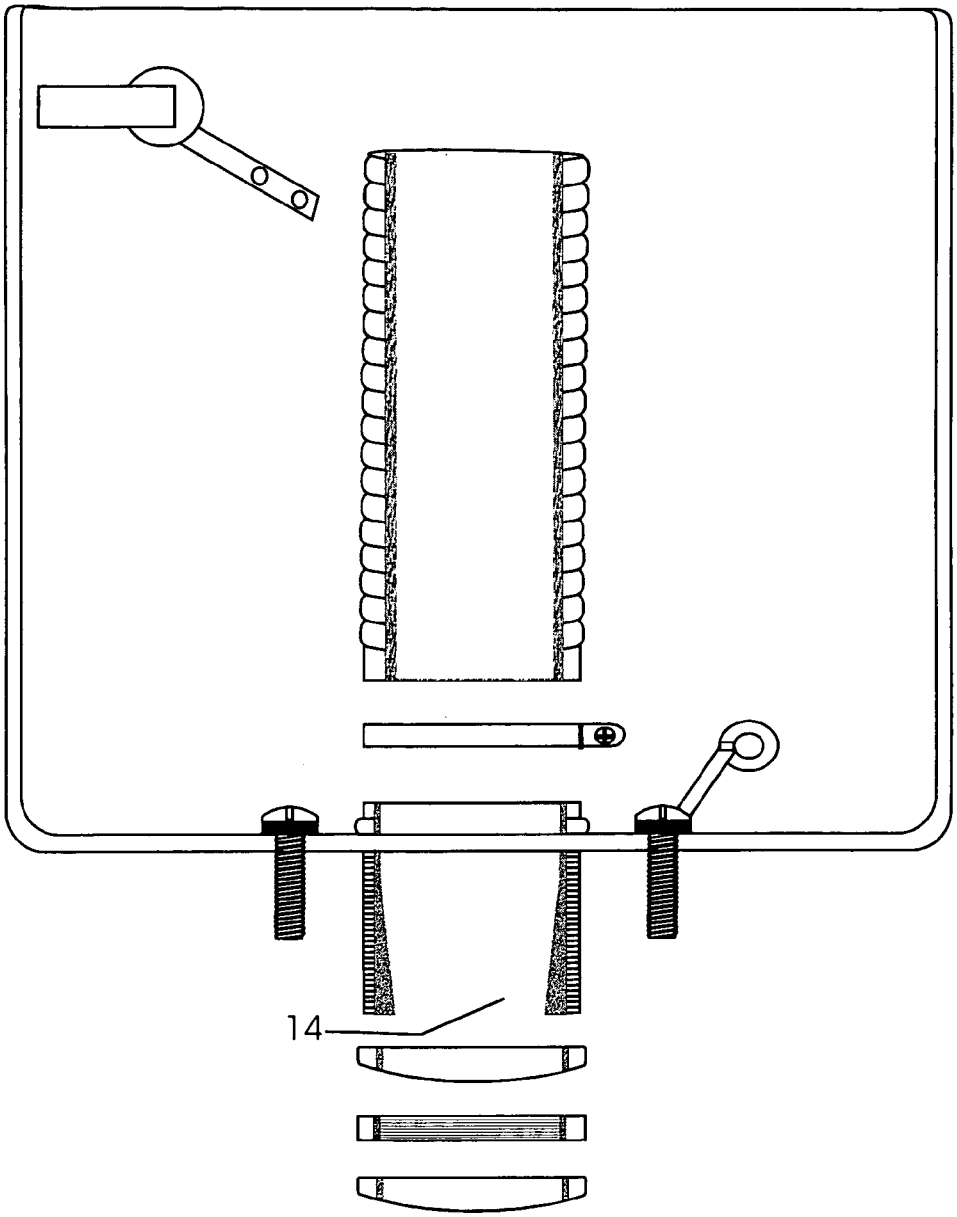
Figure 5:
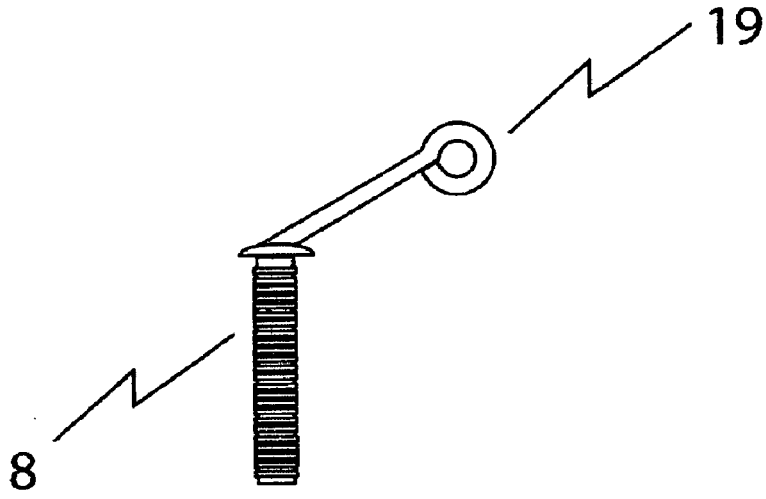
Figure 6:
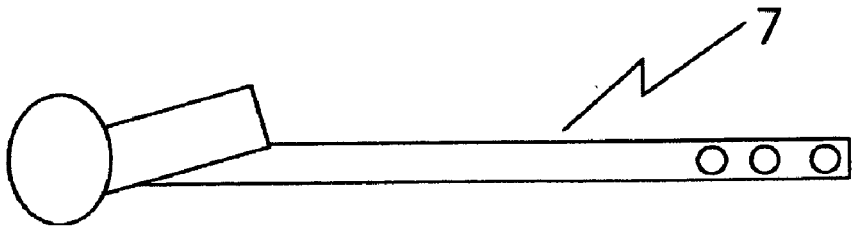

FIG. 1 shows an exploded view of the main parts of the claimed flushing valve. A couple (1) holds the flexible ringed hose (2) which is sealed or held to the couple (1) by a band (10). The couple (1) with the flexible ringed hose (2) communicates with the center hole (14) on the toilet tank and forms a passage through for liquids from the toilet tank to the toilet bowl. On the lower threaded section of the couple (1) is a gasket (3) for sealing the hole (14) on the tank which is reinforced by the nut (4). The gasket (5) is placed at the end of the couple (1) to sit the tank to the bowl. The connection between the toilet tank and the toilet bowl is tightened by screws (8) and (9) that are shown in FIGS. 2, 3, 4, 5 and 7. The handle (7) shown in FIGS. 2, 3, and 6 is used to pull the wire (6) to bend the flexible ringed hose and flush for a discharge. When the flexible hose is bent such that the top opening of the hose becomes submerged into the water as shown in FIG. 3 form its position shown in FIG. 2, water enters the hose and flushes the waste on the bowl. Water stops flowing through the hose when the water level falls below the top opening of the hose or when the pull on the wire (6) is released, thereby reverting the hose to its original vertical position. The discharge of water is made quicker and effective by reducing the inner diameter of the couple (1) from 10% to 20% less than the hose diameter which also consequently reduces the flow diameter of the hole (14) as shown in FIG. 4 FIG 5 shows that the right screw (8) which attaches the tank to the bowl, is modified on its upper part by having a rod with a slight angle along with a ring in the upper section. The left screw (9) on the other hand, is a traditional screw which attaches the tank to the bowl in the normal way. A nut, gasket and a washer is applied to each screw to prevent leakage of water through the screws before attaching it to the bowl.

DESCRIPTION AND NUMBERING OF THE DIFFERENT PARTS IN THE DRAWINGS

FIG. 1.—Exploded front view of the parts of the valve.

FIG. 2.—Front view of the assembled valve inside a tank.

FIG. 3.—Front view of the valve in a flushing mode where the flexible ringed hose is bent, pulled by the handle through the wire and guided by the loop or ring on top of the screw, which together with the other screw attaches the tank to the toilet bowl.

FIG. 4.—Exploded transversal view of the valve parts of FIG. 1 in a tank showing the reduction in the inner diameter of the lower part of the couple (1) causing a reduction in the inner flow diameter of the hole (14).

FIG. 5.—Front view of screw (8) attaching to the bowl modified to guide the wire or cable.

FIG. 6.—Front view of the pulling handle.

Figure 7:
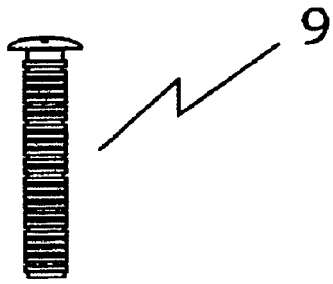

FIG. 7.—Front view of left screw (9) attaching to the bowl.

Referring to these figures this flushing valve is formed by an ensemble of a plastic couple (1) as shown in FIG. 1 which has a flat area in its upper part (11) for insertion into the flexible ringed hose (2). The couple (1) has a circular lip top (12) that holds the gasket (3) and seals the tank from the inside. The lower threaded part (13) of the couple receives the mentioned packing or gasket (3), the nut (4) and the rubber packing bowl (5). Through this couple ensemble, the flexible ringed hose (2) sends the water to the bowl through the hole (14). In the lower part end of the hose (2) is a skirt (15) that inserts into the flat upper part (11) of the couple (1) which is attached together by a brace (10) to seal both pieces. At the penultimate ring (16), that is, one ring before the last ring, located at the upper part of the flexible ringed hose (2) is a cable, string or wire (6) hereinafter collectively referred to as wire, tied to or wrapped around the hose to pull the hose as shown in FIGS. 2 and 3. The conic rubber packing or gasket (3) inserts through the threaded part of the couple (1) and situates on the top of the tank as shown in FIGS. 2 and 3. The orifice of the bowl is sealed by the nut (4) inserting into the threaded part of the couple (1) and covered by the packing bowl (5). The packing bowl also inserts through the threaded part of the couple (1) to cover the nut as shown in FIGS. 2 and 3. The cable (6) as shown in FIGS. 1, 2 and 3 has a double staple (17) with two orifices through which the cable goes through to make a loop to seal the staple and hold the hose (2) as shown in FIGS. 2 and 3. This is best done by using tweezers. The other end of the cable (18) goes through the ring (19) shown in FIGS. 2, 3, and 5 and is tied to one of the holes at the extreme part of the handle (7) as shown by FIGS. 2, 3, and 6. The ring (19) which is inclined is at the modified top of the screw (8) shown in FIGS. 2, 3, and 5. The screw (9) shown in FIGS. 2, 3, and 7 on the left side of the tank, opposite screw (8), is not modified and like screw (8), attaches the tank to the bowl. Screw (9) attaches in the normal way. The band clip (10) shown in FIGS. 1, 2, 3, and 4 is placed around the lower part (15) of the hose (2) and tightened with the screw (20) to seal the hose (2) with the couple (1). The hose may be sealed not only by a band but by an o-ring or by gluing the hose to couple (1).

Having sufficiently described my invention I consider it as a novelty and therefore I lay claim as of my exclusive property what is contained in the following clause:

1. A discharge valve for toilet tanks, comprising:

a flexible ringed hose;

a couple holding the flexible ringed hose, the flexible ringed hose and couple communicating with and sealed to a center hole of the toilet tank forming a passage through of liquids from the toilet tank to a toilet bowl;

a handle connected to a wire wrapping around an upper part of the flexible ringed hose, the wire running from the flexible ringed hose to the handle through an inclined ring on a modified top of a screw for guiding the wire, the wire through the ring connected to the handle bending the flexible hose when the handle pulls the wire upwards and allowing the flexible ringed hose to go back to its original vertical position when the pull on the wire is released;

means for holding the flexible ringed hose by the couple;

means for sealing the couple and flexible ringed hose to the center hole; and, means for connecting the toilet tank to the toilet bowl and sealing the connecting means between the toilet tank and the toilet bowl.

2. The discharge valve of claim 1 wherein the flexible ringed hose is held to the couple by a band.

3. The discharge valve of claim 2 wherein the band is placed around a lower part of the flexible ringed hose and tightened with a screw.

4. The discharge valve of claim 1 wherein the flexible ringed hose inserts into a flat area on an upper part of the couple.

5. The discharge valve of claim 4 wherein a skirt at a lower end of the flexible ringed hose inserts into the flat area of the couple.

6. The discharge valve of claim 5 wherein a brace attach and seal the skirt to the flat area of the couple.

7. The discharge valve of claim 1 wherein the couple has a circular lip top for holding a couple ensemble sealing the couple holding the flexible ringed hose to the toilet tank.

8. The discharge valve of claim 7 wherein the couple ensemble comprises a gasket, a nut and a rubber packing bowl.

9. The discharge valve of claim 7 wherein the couple ensemble inserts into a threaded part of the couple.

10. The discharge valve of claim 1 wherein the wire wrap around a penultimate ring of the flexible ringed hose.

11. The discharge valve of claim 1 wherein the wire has a double staple having two orifices through which the wire goes through to make a loop for sealing the staple and holding the flexible ringed hose.

12. The discharge valve of claim 1 wherein the wire ties to a hole at an extreme part of the handle.

13. The discharge valve of claim 1 wherein the toilet tank and toilet bowl are connected by a pair of screws.

14. The discharge valve of claim 13 wherein one screw is an ordinary screw while the other screw is a modified screw having a slightly angled rod with the ring at the upper part of said screw.

* * * * *